United States Patent [19]

Bullitt

[11] Patent Number: 4,605,608

[45] Date of Patent: Aug. 12, 1986

[54] IMAGE-RECEIVING ELEMENT WITH CROSSLINKED HYDROPHILIC POLYMER CONTAINING PROCESSING COMPOSITION

[75] Inventor: Julian G. Bullitt, Waban, Mass.

[73] Assignee: Polaroid Corporation, Cambridge, Mass.

[21] Appl. No.: 779,281

[22] Filed: Sep. 23, 1985

[51] Int. Cl.[4] ..... G03C 5/54; G03C 5/30; G03C 1/48

[52] U.S. Cl. ..... 430/206; 430/208; 430/215; 430/227; 430/234; 430/404; 430/935

[58] Field of Search ..... 430/208, 206, 215, 227, 430/234, 404

[56] References Cited

U.S. PATENT DOCUMENTS

| | | | |
|---|---|---|---|
| 2,558,857 | 7/1951 | Land | 430/208 |
| 3,345,165 | 10/1967 | Land | 430/404 |
| 3,615,482 | 10/1971 | Cronig | 430/456 |
| 3,647,464 | 3/1972 | Smith et al. | 430/206 |
| 3,689,272 | 9/1972 | Schwan et al. | 430/206 |
| 3,907,563 | 9/1975 | Land | 430/206 |

FOREIGN PATENT DOCUMENTS

| | | | |
|---|---|---|---|
| 1121277 | 7/1968 | United Kingdom | 430/206 |

*Primary Examiner*—Richard L. Schilling

[57] ABSTRACT

An image-receiving element for use in a diffusion transfer process comprising a transparent support carrying an image-receiving layer and a hydrogel comprising a hydrophilic polymer layer cross-linked by ionizing radiation, said polymer layer containing aqueous alkaline photographic processing composition.

14 Claims, 2 Drawing Figures

IMAGE-RECEIVING ELEMENT WITH CROSSLINKED HYDROPHILIC POLYMER CONTAINING PROCESSING COMPOSITION

BACKGROUND OF THE INVENTION

Diffusion transfer photographic products and processes are known to the art and details relating thereto can be found in U.S. Pat. Nos. 2,983,606; 3,415,644; 3,415,645; 3,415,646; 3,473,925; 3,482,972; 3,551,406; 3,573,042; 3,573,043; 3,573,044; 3,576,625; 3,576,626; 3,578,540; 3,569,333; 3,579,333; 3,594,164; 3,594,165; 3,597,200; 3,647,437; 3,672,486; 3,672,890; 3,705,184; 3,752,836; 3,857,865, all of which are incorporated here in their entirety. Essentially, diffusion transfer photographic products and processes involve film units having a photosensitive system including at least one silver halide layer, usually integrated with an image-providing material. After photoexposure, the photosensitive system is developed to establish an imagewise distribution of a diffusible image-providing material, at least a portion of which is transferred by diffusion to an image-receiving layer capable of mordanting or otherwise fixing the transferred image-providing material. In some diffusion transfer products, the transfer image is viewed by reflection after separation of the image-receiving element from the photosensitive system. In other products, however, such separation is not required and instead the transfer image-receiving layer is viewed against the reflecting background usually provided by a dispersion of a white reflecting pigment, such as, for example, titanium dioxide. The latter type of film unit is generally referred to in the art as integral negative-positive film units and are described, for example, in the above-mentioned U.S. Pat. Nos. 3,415,644 and 3,594,165.

U.S. Pat. No. 3,362,819, issued Jan. 9, 1968, teaches image-receiving elements particularly adapted for use in the above-described diffusion transfer processes which comprise a support carrying on one surface thereof, in sequence, a polymeric acid layer, preferably an inert timing or spacer layer, and an image-receiving layer adapted to provide a visible image upon transfer to said image-receiving layer of diffusible dye image-forming substance.

Additional details relating to photographic diffusion transfer processes, elements and film units may be found in Research Disclosure, November 1976, No. 15162.

It is known that exposed photographic film units, including diffusion transfer photographic film units may be processed by so-called web processing wherein the photographic reagents are carried to the exposed film units by means of a web or pod. Examples of such processes will be described in the following patents.

U.S. Pat. No. 3,615,482, issued Oct. 26, 1971 is directed to a gellable photoprocessing composition comprising an aqueous photoprocessing solution and a reversible gel-former selected from a carrageneen, furcellarans and combinations thereof. The gellable compositions are employed in a process which comprises heating the gellable composition; contacting a photosensitive medium with the heated gellable composition; cooling the processing composition to a temperature below its setting temperature to form a gelled processing composition and then removing the gelled processing composition from the photosensitive medium.

British Pat. No. 1,121,277, published July 24, 1968, is directed to a method for developing an exposed silver halide emulsion which comprises contacting the emulsion layer with a substantially dry-to-the-touch medium comprising a support sheet and a gelled coating on the support sheet including a colloid binder and various photoprocessing materials. Upon the application of heat to the dry-to-the-touch medium, water is releasable therefrom and activates a silver halide developing agent associated with the emulsion. It is also taught that the processing medium itself can serve as the image-receiving layer.

U.S. Pat. No. 2,558,857, issued July 3, 1951, is directed to a photographic developer element comprising a support carrying an image-receiving layer and a layer of viscous processing composition. The viscous processing composition receives its viscosity from a film-forming material such as sodium alginate, hydroxyethyl cellulose and the like. The photographic developer element is contacted with an exposed photosensitive element so that the viscous layer of processing materials contacts the photosensitive element. The viscous processing composition permeates into the exposed photosensitive element developing the latent image therein and soluble silver complexes transfer to the image-receiving layer. The photographic developer element which now contains the developed silver image is then separated from the photosensitive element.

U.S. Pat. No. 3,907,563, issued Sept. 23, 1975, is directed to a diffusion transfer process wherein the image-receiving element is impregnated with a photographic processing liquid. A photosensitive element having dye image-providing materials associated therewith is exposed and then laminated to the described image-receiving element. The processing composition retained in the image-receiving element will diffuse to the photosensitive element developing the latent image contained therein and providing for the imagewise transfer of dye to the image-receiving layer. The image-receiving layer and photosensitive element are maintained as an integral unit.

Other patents which disclose photographic processing composition in association with image-receiving layers include, for example, U.S. Pat. Nos. 2,572,357, issued Oct. 23, 1951; 2,616,804, issued Nov. 4, 1952; and 3,345,165, issued Oct. 3, 1967.

SUMMARY OF THE INVENTION

The present invention is directed to an image-receiving element for use in a diffusion transfer process which element comprises a transparent support carrying an image-receiving layer and a hydrogel comprising hydrophilic polymer cross-linked by ionizing radiation, said hydrogel containing aqueous alkaline photographic processing composition.

DETAILED DESCRIPTION OF THE INVENTION

Figure 1:
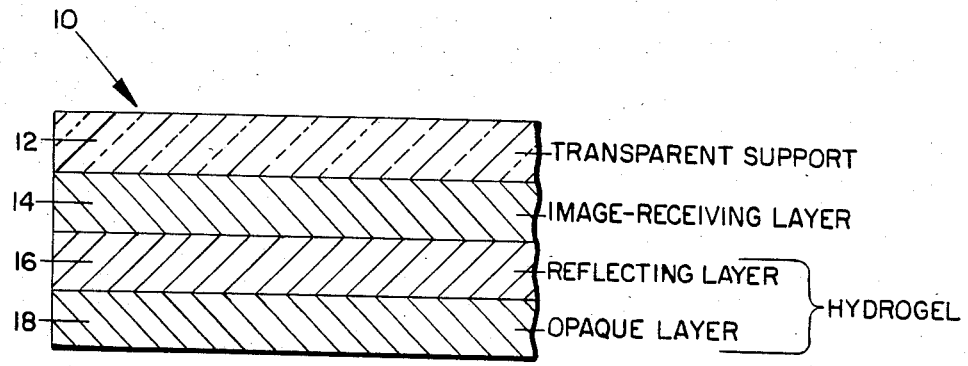
FIG. 1 is a cross-sectional diagrammatic view of an image-receiving element within the scope of the present invention.

The present invention is directed to a diffusion transfer photographic film unit and particularly to an image receiving element adapted for use with such a film unit.

The image-receiving element of the present invention is of the type that contains a substantially non-viscous, aqueous alkaline photographic processing composition carried therein. Upon face-to-face contact, as by lamination, with an exposed diffusion transfer photosensitive element, a quantity of the processing composition contained in the image-receiving element is absorbed by the photosensitive element, thereby initiating development and transfer of the image-forming material to the image-receiving layer.

An image-receiving element containing photographic processing composition must meet a number of severe requirements. Since the processing composition is alkaline in pH, the materials employed must be stable, in an alkaline environment. In some instances, the pH may be as high as 12 or more. The layers of the image-receiving element must contain sufficient dimensional stability to insure the laminate remains intact and must not permit synerisis. Still further, the materials employed in the image-receiving element must not present a barrier to the diffusing dye image-forming materials.

It has been found that the novel image-receiving element of the present invention possesses superior characteristics compared to prior art materials.

The novel image-receiving element of the present invention may be employed with any diffusion transfer photosensitive element. In one embodiment, the image-receiving layer may contain silver precipitating nuclei and the processing composition a silver solvent to provide a silver diffusion transfer image.

In another embodiment, the photosensitive element may have dye-image providing material associated with one or more silver halide layers and the image-receiving layer and may be a dye image-receiving layer to provide a monochrome or polychrome dye image.

The support in the image-receiving element may be opaque or transparent. If the support is opaque then the layer retaining the diffused dye image will be detached from the photosensitive element to permit viewing. If the support is transparent, the layer retaining the diffused dye image may be retained with the photosensitive element as an integral unit or it may be separated therefrom. If the support is transparent, the image-receiving element will require at least an opaque layer to permit processing outside of the camera. A transparency print may be obtained by separating the image-receiving layer from the photosensitive element at the opaque layer. By employing both an opaque and reflective layer, a reflection print will be produced which can be retained as an integral part of the photosensitive element or separated therefrom. To facilitate separation, stripping layers, which are well-known in the photographic art, may be employed at whatever point it is desired to separate the various components.

It will also be seen that the photosensitive element can employ a transparent or opaque support and, depending upon the product desired, exposure can be carried out from either side.

It should be understood that the hydrogel layer may constitute a separate layer or be a component of another layer. If the image-receiving element contains reflective and/or opaque layers, the hydrogel is preferably employed as the binder for the reflective and opaque material, e.g., titanium dioxide and carbon black.

Figure 2:
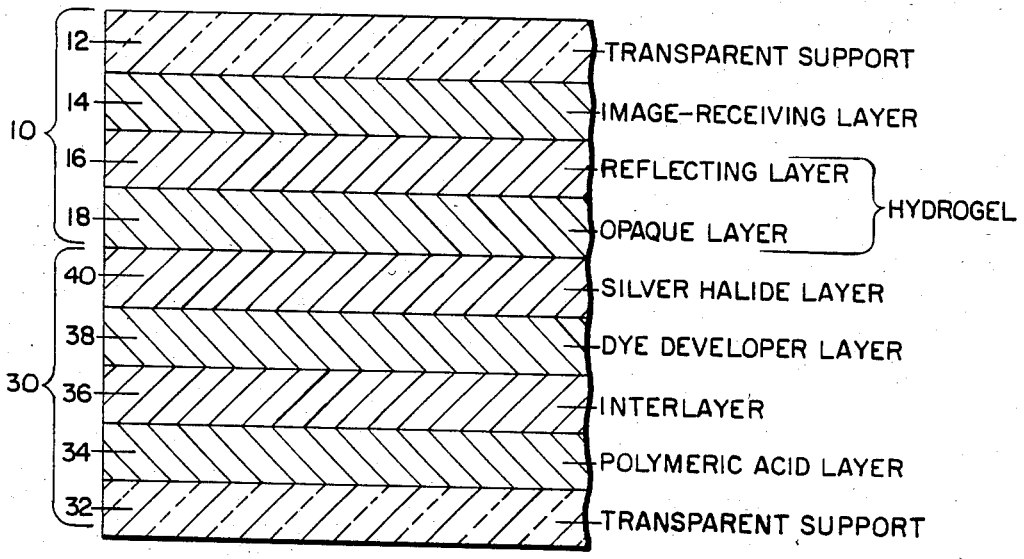
FIG. 2 is a cross-sectional diagrammatic view of an image-receiving element within the scope of the present invention laminated to a photosensitive element.

Turning now to the drawings, in FIG. 1 there is illustrated a preferred image-receiving element 10 which comprises transparent support 12 carrying image-receiving layer 14, reflective layer 16 and opaque layer 18. A hydrogel is the binder for layers 16 and 18. In FIG. 2, image-receiving element 10, as illustrated in FIG. 1 is shown laminated to photosensitive element 30 which comprises transparent support 32, polymeric acid layer 34, interlayer 36, dye developer layer 38 and silver halide layer 40.

The novel image-receiving element of the present invention is formed by coating the described layers on a transparent support, including a hydrophilic polymer, cross-linking the polymer by ionizing radiation to form a hydrogel and then imbibing aqueous processing composition into said hydrogel. More specifically, the method comprises coating a transparent support with a dye image-receiving layer, a reflective layer, an opaque layer and a hydrophilic polymer, forming a hydrogel of the water-soluble polymer by subjecting the polymer to a dose of ionizing radiation sufficient to cross-link the polymer and then imbibing aqueous photographic processing composition into the layers. The resulting element is subtantially dry to the touch, yet readily gives up the processing composition when contacted with the exposed photosensitive element.

For simplicity, the image-receiving element of the present invention has been described in terms of the hydrogel layer containing the photographic processing composition. It will be appreciated, that while the greatest quantity of the photographic processing composition may be carried by the hydrogel layer, the other layers of necessity will be wetted by and contain photographic processing composition. In fact, if they did not contain processing composition, the dye image-forming material could not diffuse to the image-receiving layer.

As examples of suitable polymers which may be employed to form the hydrogel in the present invention, mention may be made of polyethylene oxide, polyvinyl alcohol, hydroxyethylcellulose, and mixtures of polyvinyl alcohol with other hydrophilic polymers such as acrylic acid.

By means of the present invention, polymers which normally would be unsuitable for carrying the processing composition can be satisfactorily employed in the present invention as a result of the cross-linking by ionizing radiation.

The term "ionizing radiation", as used herein, is intended to refer to that radiation which has sufficient energy to cause electronic excitation and/or ionization in the polymer molecules but which does not have sufficient energy to effect the nuclei of the constituent atoms. Convenient sources of suitable ionizing radiation are gamma ray-producing radioactive isotopes such as $^{60}Co$ and $^{137}Cs$, spent nuclear fuel elements, X-ray machines, and electrons produced by such means as Van de Graaff accelerators, linear electron accelerators, resonant transformers, and the like.

The exact amount of ionizing radiation to which the polymers are subjected depends upon a number of variables including the specific polymer employed and the degree of cross-linking or desired gel strength of the hydrogel. Suitable ionizing radiation energies for use in the present invention generally range from about 20 key to 10 Mev with doses of 1–10 Mrads.

The hydrophilic polymers are subjected to the ionizing radiation in the swollen state prior to imbibing processing composition therein.

It should be understood that the processing composition necessary for image formation may be entirely disposed in the image-receiving element or only a portion disposed in the image-receiving element and the remainder initially disposed in one or more layers of the photosensitive element. In a preferred embodiment only an aqueous alkaline solution is disposed in the image-receiving element which serves to activate the remaining processing materials disposed in the photosensitive element.

The following non-limiting examples illustrate the preparation of image-receiving elements within the scope of the present invention.

EXAMPLE 1

The following layers were coated on a 4 mil corona treated clear polystyrene support:

1. an image-receiving layer consisting of 3228 mg/m$^2$ of a graft copolymer of 4-vinylpyridine and trimethylammonium vinyl benzyl chloride onto hydroxyethyl cellulose at a weight ratio of 2.2/2.2/1.
2. about 12 g/m$^2$ titanium dioxide, about 1440 mg/m$^2$ of polyethylene oxide (sold under the trade name POLYOX WSR-N-750 by Union Carbide Co., New York, NY) and 67 g/m$^2$ water.

Immediately after coating, the layers were irradiated with 2 MRads of 20 kev electrons. The layers were kept moist before and after irradiation. The moist layers were then imbibed for 1.5 min. with an aqueous solution containing 0.9N KOH and 1.8% phenethylalphapicolinium bromide.

The following non-limiting example illustrates the method of processing photosensitive elements with the image-receiving element of the present invention.

EXAMPLE 2

A photosensitive element was prepared by coating, in succession, on a gelatin subbed, opaque polyethylene terephthalate film base, the following layers:

1. A neutralizing layer of a partial butyl ester of polyethylene/maleic anhydride copolymer at a coverage of about 23,700 mg/m$^2$ and polyvinylbutyral at a coverage of about 2,690 mg/m$^2$;
2. A timing layer coated at a coverage of about 3500 mg/m$^2$ of a 60-30-4-6 tetrapolymer of butylacrylate, diacetone acrylamide, styrene and methacrylic acid, and about 52 mg/m$^2$ of gelatin;
3. A layer comprising

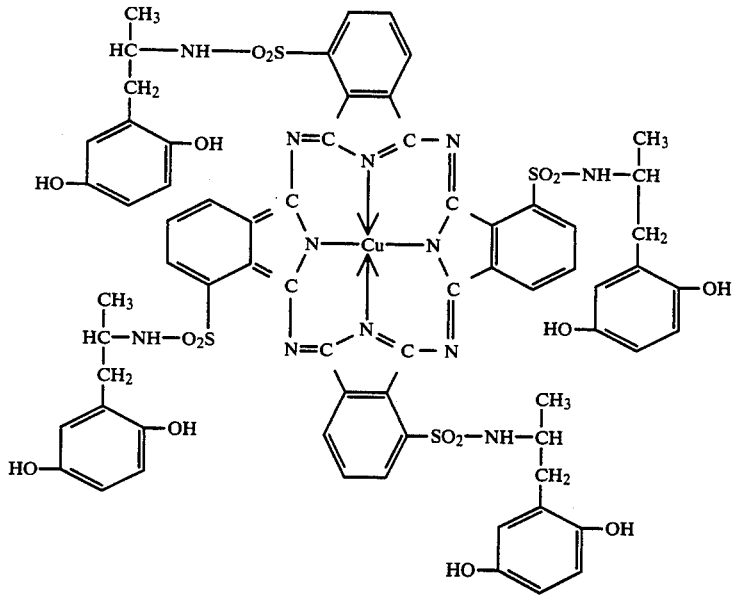

dispersed in gelatin at a coverage of about 800 mg/m$^2$ of dye and about 400 mg/m$^2$ of gelatin;

4. a red-sensitive gelatin silver iodobromide emulsion layer comprising a 50/50 mixture of 0.5 and 1.3 micrometer grains coated at a total coverage of about 1600 mg/m$^2$ of silver and about 980 mg/m$^2$ of gelatin;
5. an interlayer coated at a coverage of about 1300 mg/m$^2$ of the 30/14/3/4/34/15 hexapolymer of butyl acrylate, ethyl acrylate, methyl methacrylate, acrylic acid, diacetone acrylamide and carboxymethyl acrylate; about 20 mg/m$^2$ of polyvinyl pyrrolidone and 25 mg/m$^2$ succindialdehyde;
6. a layer comprising the magenta dye developer

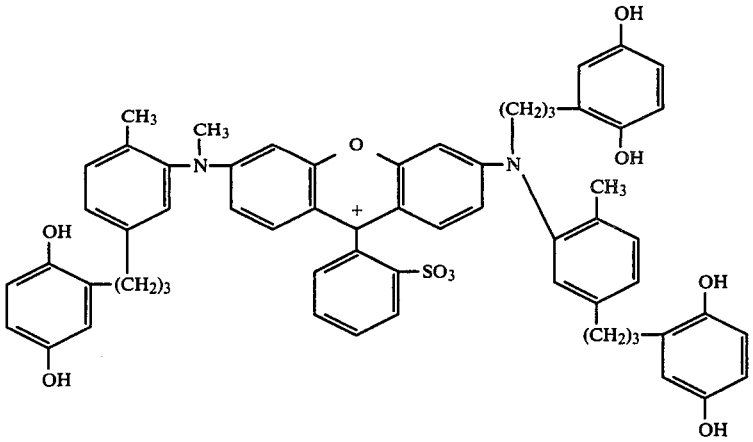

dispersed in gelatin and coated at a coverage of about 530 mg/m$^2$ of dye and about 265 mg/m$^2$ of gelatin;

7. a green-sensitive gelatino silver iodobromide emulsion comprising a blend of 0.5 micrometer grains at a coverage of about 440 mg/m$^2$ of silver and 1.3 micrometer grains at a coverage of about 440 mg/m$^2$ of silver and about 346 mg/m$^2$ of gelatin;
8. an interlayer containing the tetrapolymer referred to above in layer 2 at a coverage of about 2000 mg/m$^2$ and about 100 mg/m$^2$ of polyacrylamide;
9. a layer comprising the yellow dye developer

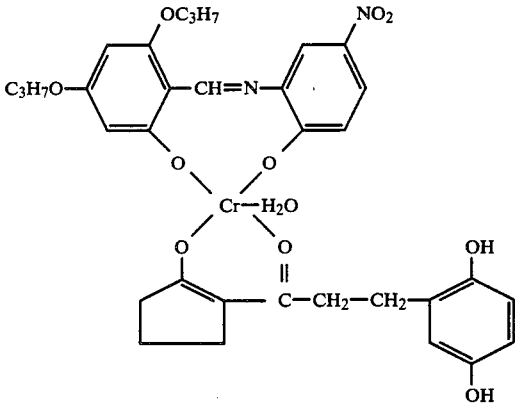

dispersed in gelatin and coated at a coverage of about 650 mg/m$^2$ of dye and about 260 mg/m$^2$ of gelatin, and about 60 mg/m$^2$ of methylvinylsulfone adduct of phenyl mercapto tetrazole;

10. a blue-sensitive gelatino silver iodobromide emulsion layer comprising a blend of 0.5 and 1.3 micrometer grains each coated at a coverage of about 525 mg/m$^2$ of silver, about 693 mg/m$^2$ of gelatin, and about 360 mg/m$^2$ of 4'-methylphenylhydroquinone;
11. an overcoat layer coated at a coverage of about 430 mg/m$^2$ gelatin containing 215 mg/m$^2$ of crushed granite.

The thus-prepared photosensitive element was exposed to a step tablet and a continuous wedge at 2 MCS and processed by laminating the image-receiving element of Example 1 to the gelatin overcoat.

Densities obtained from the resulting image are set forth in the table.

TABLE

| $D_{max}$ | | | $D_{min}$ | | |
|---|---|---|---|---|---|
| Red | Green | Blue | Red | Green | Blue |
| 1.74 | 2.12 | 1.94 | 0.28 | 0.25 | 0.40 |

For convenience, the preferred embodiment of the present invention has been described employing dye developers as the dye image-forming materials. It should be understood, however, that other techniques known to the art may also be used, including complete dyes and dye intermediates.

Photographic diffusion transfer processes and materials employable therein are well known to the art. As examples of such processes and suitable materials useful in the practice of the present invention, mention may be made of the materials and processes disclosed and referenced in Research Disclosure 15162, November, 1976, which is incorporated herein by reference.

What is claimed is:

1. An image-receiving element for diffusion transfer processing which comprises a support carrying an image-receiving layer and a hydrogel comprising a hydrophilic polymer cross-linked by ionizing radiation, said hydrogel containing aqueous alkaline photographic processing composition.

2. The product of claim 1 which includes an opaque layer and a reflective layer and said hydrogel comprises the binder for said opaque layer and said reflective layer.

3. The product of claim 1 wherein said image-receiving layer includes a dye mordant.

4. The product of claim 1 wherein said image-receiving layer includes silver precipitating nuclei.

5. The product of claim 1 wherein said support is transparent.

6. The product of claim 1 wherein said support is opaque.

7. The product of claim 1 wherein said polymer is polyethylene oxide.

8. The product of claim 1 wherein said processing composition has a pH$\geqq$12.

9. A method for forming an image-receiving element for use in a diffusion transfer process which comprises the steps of (a) coating a transparent support with an image-receiving layer and a hydrophilic polymer;

(b) gelling said polymer to form a hydrogel by subjecting said polymer to sufficient ionizing radiation to form said hydrogel; and (c) imbibing aqueous photographic processing composition into said hydrogel.

10. A method for forming a diffusion transfer image which comprises the steps of (a) exposing a photosensitive element comprising a first support carrying at least a first photosensitive silver halide emulsion layer;

(b) superposing an image-receiving element to the outermost layer of said photosensitive element; said image-receiving element comprising a second support carrying an image-receiving layer and a hydrogel, said hydrogel comprising a hydrophilic polymer cross-linked with ionizing radiation and an aqueous alkaline photographic processing composition; whereby a sufficient quantity of said processing composition is absorbed by said photosensitive element to develop said photosensitive silver halide layer, and transferring an imagewise distribution of image-forming material to said image-receiving layer.

11. The method of claim 10 wherein said silver halide layer has dye image-forming material associated therewith and said image-receiving layer is a dye image-receiving layer.

12. The method of claim 10 wherein said processing composition includes a silver solvent and said image-receiving layer includes silver precipitating nuclei.

13. The method of claim 10 wherein said image-receiving element includes an opaque and a reflective layer and said second support is transparent.

14. The method of claim 10 which includes the step of stripping said image-receiving element from said photosensitive element subsequent to subtantial image formation.

* * * * *